US010349673B2

(12) United States Patent
Volgger

(10) Patent No.: US 10,349,673 B2
(45) Date of Patent: Jul. 16, 2019

(54) FILM-FORMING COMPOSITION FOR APPLYING TO CIGARETTE PAPER

(75) Inventor: Dietmar Volgger, Schwaz (AT)

(73) Assignee: Delfortgroup AG, Traun (AT)

( * ) Notice: Subject to any disclaimer, the term of this patent is extended or adjusted under 35 U.S.C. 154(b) by 1155 days.

(21) Appl. No.: 13/378,653

(22) PCT Filed: Jun. 23, 2010

(86) PCT No.: PCT/EP2010/003872

§ 371 (c)(1),
(2), (4) Date: Mar. 2, 2012

(87) PCT Pub. No.: WO2010/149380

PCT Pub. Date: Dec. 29, 2010

(65) Prior Publication Data

US 2012/0152266 A1 Jun. 21, 2012

(30) Foreign Application Priority Data

Jun. 25, 2009 (DE) ..... 10 2009 030 546

(51) Int. Cl.
*A24D 1/02* (2006.01)

(52) U.S. Cl.
CPC ..... *A24D 1/025* (2013.01)

(58) Field of Classification Search
None
See application file for complete search history.

(56) References Cited

U.S. PATENT DOCUMENTS 3,526,904 A 9/1970 Tamol
4,889,145 A * 12/1989 Adams ..... D21H 5/16 131/365
5,722,433 A 3/1998 Ishino et al.
6,779,530 B2 * 8/2004 Kraker ..... A24C 5/005 131/349

(Continued)

FOREIGN PATENT DOCUMENTS

AT 005 523 U1 8/2002
DE 601 30 153 T2 5/2008
JP 2005508648 A 4/2005
JP 2006517391 A 7/2006

(Continued)

OTHER PUBLICATIONS

Kuntz, Lynn A., "Making the Most of Maltodextrins" Food Product Design, Aug. 1997, Virgo Publishing, http://www.foodproductdesign.com/articles/1997/08/making-the-most-of-maltodextrins.aspx.*

(Continued)

*Primary Examiner* — Michael J Felton
(74) *Attorney, Agent, or Firm* — Steven J. Grossman; Grossman Tucker Perrault & Pfleger PLLC

(57) ABSTRACT

The present invention relates to a composition having two or three film-forming agents for applying to cigarette paper, wherein the molecular weight distributions of the film-forming agents are statistically significantly different from each other. The invention further relates to a cigarette paper on which the composition is applied to discrete regions, wherein the regions are characterized by a value for diffusivity, and to a cigarette comprising the cigarette paper, characterized by values for auto-selection. The present invention further relates to a method for producing the cigarette paper and the cigarette.

15 Claims, 1 Drawing Sheet

(56) References Cited

U.S. PATENT DOCUMENTS

| | | | | |
|---|---|---|---|---|
| 7,219,672 | B2 * | 5/2007 | Tosas Fuentes | A24D 1/02 131/365 |
| 2004/0221861 | A1 | 11/2004 | Eibl | |
| 2008/0115794 | A1 * | 5/2008 | Oglesby | A24D 1/025 131/58 |
| 2009/0120450 | A1 | 5/2009 | Herve et al. | |

FOREIGN PATENT DOCUMENTS

| | | | |
|---|---|---|---|
| WO | 2003041521 | A2 | 5/2003 |
| WO | 2004047572 | A1 | 6/2004 |

OTHER PUBLICATIONS

"Grado/DIN 4mm Viscosity Cup", Paul N. Gardner Company, Inc., accessed on Sep. 21, 2016 via https://www.gardco.com/pages/viscosity/vi/din_cups.cfm.*

R. G. Gilbert, M. J. Gidley, S. Hill, P. Kilz, A. Rolland-Sabaté, D. G. Stevenson and R. A. Cave, "Characterizing the Size and Molecular Weight Distribution of Starch: Why It Is Important and Why It Is Hard", May 2010, p. 139. doi:10.1094/CFW-55-3-0139. Accessed Aug. 13, 2018 (Year: 2010).*

Eitzinger, et al, The Effect of Thermal Decomposition of Banded Cigarette Paper on Ignition Strength Test Results, Abstracts of Presentations Made at the 2008 Coresta Congress in Shanghai, China Smoke Science and Product Technology, Nov. 2-7, 2008; Abstract SSPT23 (pp. 8 & 9).

International Search Report and Written Opinion of PCT/EP2010/003872, dated Nov. 30, 2010.

Search Report of priority DE102009030546.7 dated Mar. 1, 2010.

English translation of the International Preliminary Report on Patentability dated Jan. 31, 2012 in PCT/EP2010/003872 (8 pgs).

See the IDS Transmittal letter in support of the date the Office Action dated Feb. 24, 2017 issued in corresponding Korean Patent Application No. 10-2011-7030714.

* cited by examiner

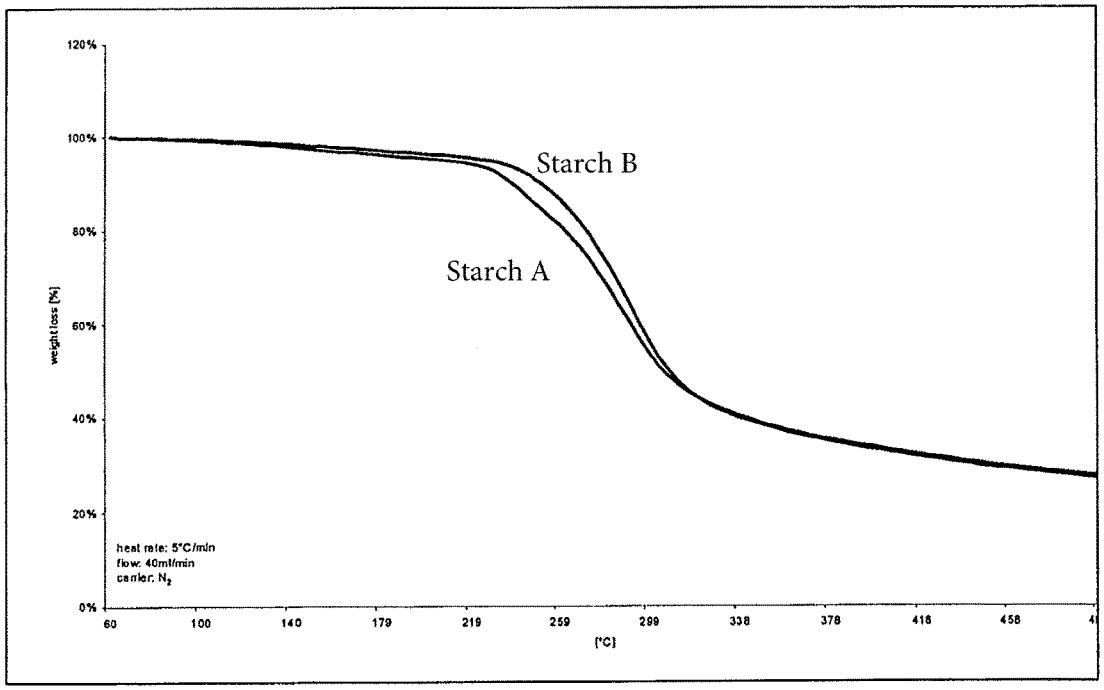
120%
100%
80%
60%
40%
20%
0%
weight loss [%]
Starch B
Starch A
heat rate: 5°C/min
flow: 40ml/min
carrier: N2
60
100
140
179
219
259
299
338
378
418
458
[°C]

FILM-FORMING COMPOSITION FOR APPLYING TO CIGARETTE PAPER

The present invention relates to a composition comprising two or three film-forming materials having different mean molecular weights for application on cigarette paper. The present invention further relates to a cigarette paper to which the composition is applied in discrete areas, wherein the areas are characterized by a value for diffusivity, as well as to a cigarette which comprises the cigarette paper and which is characterized by values for self-extinguishment. The present invention also relates to a method for manufacturing the cigarette paper and the cigarette.

PRIOR ART

An important aspect, which has to be considered when manufacturing cigarettes, is the self-extinguishment thereof. On the one hand a cigarette should go out automatically if placed on a surface not intended for this purpose, to prevent fires which are caused by glowing cigarettes left unattended. On the other hand it is unfavorable for customer acceptance if the cigarette goes out prematurely when placed in an ashtray.

The value for self-extinguishment (SE) is determined by legal requirements (USA, Canada, Australia) by means of the standardized ASTM E2187-04 test. The legal requirements require an SE value of 75% or more (in other words 30 of 40 tested cigarettes must self-extinguish). This is the lower threshold of the acceptable values. Indeed, cigarette producers must ensure that cigarettes, if tested by the authorities, reach the limit of SE>75% with very high probability. For the cigarette producers, a value of a least 85% is thus generally preferred.

The free burn (FB) test, which leads to the FB value, is not standardized and the notations used are different. Inter alia, the notation FASE (free air self-extinguishment) is used. This value has the same meaning as the FB value, but the scale is reversed. Whereas the FB value specifies how many cigarettes smolder freely up to the filter without self-extinguishment, the FASE value specifies how many cigarettes self-extinguish while smoldering freely. An FB value of 100% thus represents a FASE value of 0% and vice versa. Generally, the relation FB=100—FASE holds true. The value measured in the free burn test is not subject to legal provisions; it is down to the cigarette producers to decide what values are acceptable. FB values above 50% are generally already acceptable, whereas FB values over 70% are most advantageous.

The optimum goal sought by a cigarette producer is for the cigarettes to self-extinguish completely in the ignition strength test according to ASTM E2817-04, i.e. an SE value of 100%, but, nevertheless, for no cigarette to self-extinguish in the ashtray during the normal smoking process, which means that the FB value is thus likewise 100%. In practice this goal is very hard to achieve, which is why the limits for legally and technically acceptable values of SE and FB are lower.

To control the extinguishment characteristics, compositions with film-forming materials (film-formers or film forming agents) are applied in discrete areas on the cigarette paper. Since the film-forming materials, after removal of the solvent, for example by evaporation, form a film on the cigarette paper, the pores in the treated areas are sealed and therefore the flow of oxygen to the glowing cone of the cigarette is reduced. The aqueous or non-aqueous solutions or suspensions ("printing solutions") are generally applied by common printing methods, especially intaglio printing and flexo printing. Devices for applying the printing solutions can be integrated in the paper machine.

Also, additives are added to the printing solution to increase the opacity of the printed areas of the paper, so that these become invisible on the cigarette. Typically, white inert powders with a mean particle size between 0.5 and 3 μm are selected for this purpose. Above all, carbonates and oxides have proven to be effective, calcium carbonate ($CaCO_3$), aluminum hydroxide ($Al(OH)_3$), magnesium oxide (MgO) and magnesium carbonate ($MgCO_3$) being used particularly frequently.

The extinguishment characteristics depend, inter alia, on the pattern and size of the treated areas. In particular, however, the self-extinguishment is finely adjusted by the amount of film-forming material applied: the more material is applied, the more pores are sealed. One measure for the permeability of the treated areas is diffusivity, which is a transfer coefficient for a gas transport through the paper driven by a concentration difference. Whereas the values for SE and FB are properties of the finished cigarette, diffusivity is a property of the cigarette paper. Diffusivity is related directly to the SE and FB values (Eitzinger, Bernhard and Harald Giener. The Effect of Thermal Decomposition of Banded Cigarette Paper on Ignition Strength Test Results. Presentation CORESTA congress, Abstract SSPT23, Shanghai, China, Nov. 2-7, 2008).

The applied amount can be easily increased by increasing the content of film-forming materials in the printing solution. The viscosity of the printing solution is increased as a result. Viscosity itself in turn influences the amount of film-forming materials which can be applied to the cigarette paper, and therefore a complex relation exists between the amount of film-forming material in the printing solution and the applied amount.

Above all, however, the viscosity of the printing solution substantially influences the processability thereof during the printing process. Thus, the applied amount of the film-forming materials cannot be readily increased without possibly having to adjust the printing equipment. An increased solid content also means less solvent in the printing solution, so that the drying power of the printing equipment also has to be adjusted if necessary.

The previously known methods for applying film-forming materials do not allow fine adjustment of self-extinguishment, without special consideration of the application method and the characteristics of the application equipment. It is also no more possible to adapt the printing solution to the characteristics of the paper to be printed without also changing the settings of the application equipment.

An object of the present invention is therefore to provide a printing solution with which cigarette paper and cigarettes having the desired characteristics can be produced and which minimizes the need to adjust the application method.

SUMMARY OF THE INVENTION

The object of the present invention is achieved by a film-forming composition for application on cigarette paper, which composition comprises a solvent and two or three film-forming agents selected from the group consisting of the film-forming agents A, B and C, of which the molecular weight distributions are statistically significantly different, wherein the amount of each film-forming agent in the composition is selected accordingly so that the total content of film-forming agents in the composition is 15 to 30% by weight, preferably 22 to 27% by weight, and the viscosity of the composition is from 13 to 22 s, preferably 17.5 to 19.5 s, measured using a DIN 4 cup at 70° C.

In one embodiment of the film-forming composition the amount of each film-forming agent in the composition is selected accordingly so that the diffusivity in one or more discrete areas of the cigarette paper where the composition is applied is 0.08 to 0.5 cm/s, preferably 0.2 to 0.4 cm/s, more preferably 0.25 to 0.35 cm/s, measured after heating the paper for 30 minutes to a temperature of 230° C.

In one embodiment the film-forming composition comprises two film-forming agents A and B or A and C or B and C.

In one embodiment the film-forming composition comprises three film-forming agents A, B and C.

In one embodiment of the film-forming composition the film-forming agent A has a mean molecular weight of 200,000±50,000 g/Mol, preferably 200,000±30,000 g/Mol, more preferably 200,000±10,000 g/Mol.

In one embodiment of the film-forming composition the film-forming agent B has a mean molecular weight of 600,000±150,000 g/Mol, preferably 600,000±90,000 g/Mol, more preferably 600,000±30,000 g/Mol.

In one embodiment of the film-forming composition the film-forming agent C has a mean molecular weight of 100,000±25,000 g/Mol, preferably 100,000±15,000 g/Mol, more preferably 100,000±5,000 g/Mol.

In one embodiment of the film-forming composition the content of film-forming agent A is up to 25% by weight, preferably 5 to 15% by weight.

In one embodiment of the film-forming composition the content of film-forming agent B is up to 25% by weight, preferably 15 to 22% by weight.

In one embodiment of the film-forming composition the content of film-forming agent C is up to 20% by weight, preferably 2 to 15% by weight, more preferably 2 to 8% by weight.

In one embodiment of the film-forming composition the film-forming agents A, B and/or C are selected independently of one another from the group consisting of starch and starch degradation products, alginate, guar gum, pectin, polyvinyl alcohol and cellulose as well as the respective derivatives thereof. For example, in the case of a film-forming composition comprising two film-forming agents A and B, film-forming agent A may be an alginate and film-forming agent B may be a starch or a starch degradation product.

In one embodiment of the film-forming composition the film-forming agents A and B or A and C or B and C or A, B and C are identical. For example, in the case of a film-forming composition comprising two film-forming agents A and B or A and C or B and C, both film-forming agents are a starch or a starch degradation product or a derivative thereof. In the case of a film-forming composition comprising three film-forming agents A, B and C, all three film-forming agents may be a starch or a starch degradation product or a derivative thereof.

In one embodiment of the film-forming composition the film-forming agents A and/or B is/are a potato starch or a derivative thereof, preferably a carboxylated potato starch or a derivative thereof, and the solvent is an aqueous solvent or water.

In one embodiment of the film-forming composition the film-forming agent C is a degraded starch or a derivative thereof, preferably a maltodextrin or a derivative thereof, and the solvent is an aqueous solvent or water. In addition to influencing the viscosity of the composition, degraded starch or maltodextrin affords the advantage of improving film formation. The addition of degraded starch or maltodextrin ensures that the film does not crack, even after extensive drying. Cracks would facilitate the inflow of oxygen to the glowing cone of the cigarette and are therefore disadvantageous.

In one embodiment the film-forming composition further comprises at least one or more additives, selected from the group consisting of carbonates and oxides, preferably from the group consisting of calcium carbonate, aluminum hydroxide, magnesium oxide and magnesium carbonate.

In one embodiment of the film-forming composition the content of additives is up to 15% by weight, preferably 5 to 10% by weight.

In one embodiment of the film-forming composition the total amount of solids, including the film-forming agent and optionally at least one additive, is 15 to 45% by weight, preferably 22 to 37% by weight.

The object of the present invention is furthermore achieved by a cigarette paper which comprises one or more discrete areas in which a film-forming composition of the invention is applied, wherein the diffusivity of the discrete areas is from 0.08 to 0.5 cm/s, preferably 0.2 to 0.4 cm/s, more preferably 0.25 to 0.35 cm/s, measured after 30 minutes of heating the paper to a temperature of 230° C.

In one embodiment of the cigarette paper the applied amount of the film-forming composition is 2.5 to 6 $g/m^2$, preferably 3 to 4.5 $g/m^2$, more preferably 4 $g/m^2$. The values for the applied amount in $g/m^2$ refer to the areas of the cigarette paper to which the film-forming composition is applied.

In one embodiment of the cigarette paper the diffusivity of the areas in which no film-forming composition is applied is from 0.1 to 3 cm/s, measured at room temperature.

In one embodiment of the cigarette paper the air permeability of the areas in which no film-forming composition is applied is 10 to 200 CORESTA units, preferably 40 to 100 CORESTA units (1 CORESTA unit=1 $cm^3/(cm^2$ min kPa)).

In one embodiment the cigarette paper further comprises one or more burn additives, selected from the group consisting of citrates, malates, tartrates, acetates, nitrates, succinates, fumarates, gluconates, gycolates, actates, oxylates, salicylates, α-hydroxycaprylates and phosphates, preferably selected from the group consisting of sodium citrate and tripotassium citrate, wherein the content is particularly preferably up to 4% by weight.

The object of the present invention is further achieved by a cigarette which comprises a cigarette paper of the invention.

In one embodiment of the cigarette the value for self-extinguishment is more than 75%, preferably at least 85%, and more preferably at least 95%, and the value measured in the free burn test is greater than 50%, preferably at least 70%, more preferably at least 80%.

The object of the present invention is further achieved by a method for manufacturing a cigarette paper or for manufacturing a cigarette, said method comprising the following steps:

(a) providing a cigarette paper having a diffusivity of 0.1 to 3 cm/s, measured at room temperature, and/or an air permeability of 10 to 200 CORESTA units, preferably 40 to 100 CORESTA units;
(b) providing a film-forming composition of the present invention;
(c) applying the film-forming composition on the cigarette paper by means of printing methods, preferably by means of intaglio printing or flexographic printing.

The expression "statistically significantly different" is to be understood to mean the following: two or more materials have statistically significantly different molecular weight distributions if the $\chi^2$—homogeneity test, applied to these molecular weight distributions, shows that they are not identical with a significance level of 95%. The $\chi^2$—homogeneity test is a standard technique in statistics which makes it possible to test the hypothesis of whether two or more distributions are identical. It is a non-parametric test and therefore does not require assumptions regarding the type of distribution.

If a material is described here by its mean molecular weight, with or without the standard deviation, for example by a "mean molecular weight of 600,000±90,000 g/Mol", a normal distribution of molecular weight is assumed.

The invention comprises using a mixture of two or three film-forming material having different mean molecular weights, more precisely having statistically significantly different molecular weights. It is known that the molecular weight of a material influences the viscosity of its solution, but the correlation between solid content and viscosity is complex even in the case of individual materials, and is even more difficult to predict for mixtures. It has now surprisingly been found that, by mixing high-molecular starch and low-molecular starch as well as a mid-molecular starch on a case-by-case basis, a solution can be produced of which the total content of film-forming materials and of which the viscosity can be adjusted independently of one another by selecting the proportion of the individual starches. The characteristics of the film formed in the discrete areas can thus be selectively adjusted, without having to change the viscosity of the film-forming composition, the applied amount or the total content of film-forming materials in the printing solution. Perfect processability by the application equipment thus remains ensured, without changing the settings. For example, with a predetermined printing cylinder a wide spectrum of cigarette papers can be printed with the desired result with variation of the composition of the printing solution.

If it is desired to decrease the diffusivity of the printed areas of the cigarette paper, then it is helpful in accordance with the invention to increase the proportion of high-molecular film-forming materials and to decrease the proportion of low-molecular film-forming materials. More high-molecular film forming material is thus to be used if it is desired to change from an original cigarette paper to an alternative paper, wherein the unprinted areas have initially a higher diffusivity than the original paper. For example, this is the case if the alternative cigarette paper has greater air permeability or a greater content of filler content. This is the case if the alternative cigarette paper has a greater content of burn additives, because it then decomposes faster under thermal action. A greater proportion of high-molecular film-forming materials is also helpful if the cigarette comprises a tobacco blend which smolders particularly quickly and intensely. Of course, this principle works both ways, that is to say to increase diffusivity should less high-molecular and more low-molecular film-forming materials be used.

DETAILED DESCRIPTION OF THE INVENTION

FIG. 1 shows the thermogravimetric curves of the starches A and B.

EXAMPLES

The principle on which the invention is based is described by the example of starches and starch derivatives in aqueous solution, but can also be applied to other film-forming agents, including film-forming agents in non-aqueous solutions.

Example 1: Composition of the Printing Solution and Influence on Diffusivity as Well as SE and FB Value Different film-forming compositions were applied to a cigarette paper by a printing method. The following film-forming substances were used for the printing solution:

Starch A mean molecular weight 200,000 g/Mol
Starch B mean molecular weight 600,000 g/Mol
Starch MD mean molecular weight 100,000 g/Mol Starches A and B are carboxylated potato starch powder, the starch MD is an enzymatically degraded potato starch (maltodextrin). The solvent was water. The printing solution also contained calcium carbonate, which is normally added to make the printed bands less visible.

The film-forming composition was applied in the form of bands. The printed bands were 6 mm wide and the distance from the middle of one band to the middle of the next band was 27 mm. The bands were arranged at right angles to the direction of movement of the paper web. The printing was achieved with the aid of an intaglio printing system. This is the preferred, technically most common option, but any other desired printing geometry may also be used.

A cigarette paper having following characteristics was used:

Paper A:

| | |
|---|---|
| Basis weight | 26 g/m$^2$ |
| Fibers | flax pulp |
| Filler | calcium carbonate, 29% |
| Air permeability | 60 CU (=cm$^3$/(cm$^2$ min kPa)) |
| Burn additives | 1.0%, 50:50 mixture of sodium- and tripotassium citrate (in % of the entire paper mass) |

The cigarettes produced from this paper had the following characteristics:

| | |
|---|---|
| Length | 84 mm |
| Circumference | 24.6 mm |
| Total weight | 920 mg |
| Tobacco weight | 650 mg |
| Tobacco mixture | American Blend |

The paper was printed with three different printing solutions according to Table 1. The diffusion constant of the printed areas was then measured and the diffusivity was derived from these values. Afterwards, cigarettes were manufactured from these papers and the cigarettes were tested.

TABLE 1

| | Printing solution | | | | | | | Diffu- | | |
|---|---|---|---|---|---|---|---|---|---|---|
| Test | Starch MD [%] | Starch A [%] | Starch B [%] | Sum Starch [%] | Chalk [%] | Viscos-ity [s] | Applied amount [g/m$^2$] | sivity D* [cm/s] | SE [%] | FB [%] |
| 1 | 5 | 0 | 22 | 27 | 5 | 19.0 | 5.26 | 0.205 | 100 | 60 |
| 2 | 5 | 22 | 0 | 27 | 5 | 18.0 | 5.72 | 0.405 | 57 | 100 |
| 3 | 5 | 5 | 17 | 27 | 5 | 19.5 | 5.50 | 0.312 | 95 | 90 |

For the printing solution the percentage value denotes the content of the respective materials in percent by weight (% by weight) based on the finished printing solution. For example, the printing solution in test 1 consists of 5% by weight starch MD, 22% by weight of starch B and 5% by weight of calcium carbonate (chalk). The overall content of starch is thus 27% by weight, the total solids content is 32% by weight and the amount of material remaining to 100% by weight is water.

The viscosity is measured using a DIN 4 cup. The time required by a defined volume of the printing solution to flow through an opening in the base of the standardized cup is measured in seconds. The viscosity of the finished printing solution is measured at 70° C.

The applied amount is the additional weight per printed area unit in $g/m^2$ provided in the bands on the paper after drying.

Diffusivity describes the resistance to a gas exchange caused by a concentration difference in the area of the printed bands. It is closely related to the diffusion constant. The diffusion constant D has the unit $m^2/s$ and describes the flow rate v caused by a concentration gradient grad(c), which is given approximately by $grad(c)=(c_1-c_2)/d$, wherein d is the thickness of the paper and $c_1$ and $c_2$ are the concentrations on both sides of the paper. The following relation applies:

$$v = D \cdot grad(c) = D\frac{c_1 - c_2}{d}$$

For the technical application, however, it is of specific interest what flow rate through the paper is achieved at a given concentration difference. This should be given by a value characterizing the paper. Thus, the diffusion constant D and the thickness of the paper d are combined to give a value D* according to D*=D/d, which is called diffusivity. It has the unit m/s or cm/s and therefore makes it possible to calculate the flow rate through the band by means of the following equation:

$$v = \frac{D}{d}(c_1 - c_2) = D^*(c_1 - c_2)$$

Different papers can thus be compared on the basis of D*, without additionally having to consider their thickness. Diffusivity, as specified in Table 1, thus corresponds to the diffusion constant divided by the thickness of the paper. It is measured according to a non-standardized method using a "$CO_2$ diffusivity meter" from the company SODIM. Diffusivity thus characterizes how easily (high value) or how difficult (low value) oxygen can pass through the cigarette paper to the glowing cone of the cigarette. If the value is already sufficiently low, then the cigarette self-extinguishes. However, during glowing, the cigarette paper is highly thermally exposed in the region of the glowing cone. It has thus been demonstrated that the significance of this measured value can be increased considerably further if the papers are heated beforehand. The paper is therefore heated for 30 minutes to 230° C. in a drying oven, for example in a drying oven ED53 from the company Binder. The changes in the paper and even in the printed bands are irreversible, which is why the paper can initially be cooled down to determine the diffusivity in the region of the bands.

The SE value characterizes the result of the standardized ignition strength test according to ASTM E2187-04. In this test a glowing cigarette is placed on a substrate formed of 10 layers of the filter paper Whatman #2 and it is then checked whether the cigarette self-extinguishes. The percentage value shows how many cigarettes of a sample of 40 self-extinguish.

The FB value characterizes the result of a non-standardized test, in which a glowing cigarette is fixed in a holder in a horizontal position so that air can reach the cigarette on all sides. The cigarette therefore does not lie on a substrate. This test simulates the glowing of the cigarette in an ashtray. The percentage value shows how many cigarettes of a sample of 40 DO NOT self-extinguish.

As can be seen in Table 1, in test 1 in which the printing solution consists primarily of high-molecular starch B, a diffusivity of 0.205 cm/s was achieved. The cigarettes manufactured from the corresponding cigarette paper had an SE value of 100% and an FB value of only 60%. This means that in this example the cigarettes would self-extinguish too often in the ashtray.

In test 2 a mid-molecular starch A was used instead of high-molecular starch B. Accordingly, diffusivity increases from 0.205 cm/s to 0.405 cm/s. Thus, fewer cigarettes self-extinguish and the SE value is only 57%, whereas no cigarettes self-extinguish in the FB test and the FB value is therefore 100%. Such a cigarette self-extinguishes too rarely to comply with the legal requirements.

In test 3 a mixture of starch A and starch B was used and a diffusivity of 0.312 cm/s could be achieved. This value lies between the values obtained in test 1 (0.205 cm/s) and test 2 (0.405 cm/s). The result for the SE value is 95%, which is satisfactory, as is the result for the FB value at 90%.

In this example an applied amount of approximately 5.5 $g/m^2$ was provided, however good results can also be achieved with a significantly smaller applied amount of down to approximately 2.5 $g/m^2$.

This example shows that the desired test results for D*, SE and FB can be achieved without significantly changing the solids content of the printing solution, its viscosity or the applied amount. Therefore, an application unit, for example an intaglio printing machine, can be used to apply these differently composed printing solutions without making any adjustments on the application equipment, for example the etching depth of the printing cylinder, the speed of the paper web or the power of the drying unit. This increases the efficiency and the stability of the application process substantially.

Example 2: Influence of the Cigarette Paper

The film-forming materials, the components of the printing solution, the geometry of the bands and the characteristics of the cigarettes produced were as in EXAMPLE 1.

However, a cigarette paper having the following characteristics was used:

Paper B:

| | |
|---|---|
| Basis weight | 24 $g/m^2$ |
| Fibers | wood pulp |
| Filler | calcium carbonate, 29% |
| Air permeability | 75 CU (=$cm^3/(cm^2$ min kPa)) |
| Burn additives | 1.0% tripotassium citrate (in % of the entire paper mass) |

Paper B thus differs from paper A with regard to all essential characteristics.

TABLE 2

| Test | Printing Solution: Starch MD % | Starch A [%] | Starch B [%] | Sum Starch [%] | Chalk [%] | Viscosity [s] | Applied amount [g/m²] | Diffusivity D* [cm/s] | SE [%] | FB [%] |
|---|---|---|---|---|---|---|---|---|---|---|
| 4 | 0 | 5 | 17 | 22 | 5 | 19.0 | 4.20 | 0.250 | 100 | 80 |
| 5 | 5 | 0 | 17 | 22 | 5 | 17.5 | 4.45 | 0.280 | 97.5 | 100 |

In test 5 the mid-molecular starch A of test 4 was replaced by a low-molecular starch MD. Diffusivity increased accordingly from 0.250 cm/s to 0.280 cm/s. The test results show that satisfactory or optimum results could be achieved for the SE and FB values.

This example shows that the adjustment of the test results for D*, SE and FB to different paper characteristics can be achieved without significantly changing the solids content of the printing solution, its viscosity or the applied amount.

It is desirable for the paper manufacturer to recognize, based on the paper characteristic, and without carrying out its own tests, which results are to be expected for SE and FB. This is achieved by the diffusivity D* of the paper, because this variable can be used to predict SE and FB values. Thus, D* is the value which characterizes the paper or, more precisely, the printed areas.

Example 3: Influence of the Air Permeability of the Cigarette Paper

The film-forming materials, the components of the printing solution and the geometry of the bands were as in EXAMPLE 1.

However, cigarette papers having the following characteristics were used:

Paper C

| | |
|---|---|
| Basis weight | 26 g/m² |
| Fibers | flax pulp |
| Filler | calcium carbonate, 29% |
| Air permeability | 60 CU(=cm³/(cm² min kPa)) |
| Burn additives | 1.4% tripotassium citrate (in % of the entire paper mass) |

Paper D

| | |
|---|---|
| Basis weight | 26 g/m² |
| Fibers | flax pulp |
| Filler | calcium carbonate, 29% |
| Air permeability | 80 CU(=cm³/(cm² min kPa)) |

-continued

| | |
|---|---|
| Burn additives | 1.4% tripotassium citrate (in % of the entire paper mass) |

Paper E

| | |
|---|---|
| Basis weight | 28 g/m² |
| Fibers | wood pulp |
| Filler | calcium carbonate, 25% |
| Air permeability | 10 CU(=cm³/(cm² min kPa)) |
| Burn additives | 1.0% tripotassium citrate (in % of the entire paper mass) |

Paper F

| | |
|---|---|
| Basis weight | 25 g/m² |
| Fibers | wood pulp |
| Filler | calcium carbonate, 32% |
| Air permeability | 200 CU (=cm³/(cm² min kPa)) |
| Burn additives | 1.4% tripotassium citrate (in % of the entire paper mass) |

TABLE 3

| Test | Paper | Printing solution: Starch MD [%] | Starch A [%] | Starch B [%] | Sum Starch [%] | Chalk [%] | Viscosity [s] | Diffusivity D* [cm/s] |
|---|---|---|---|---|---|---|---|---|
| 6 | C | 5 | 2 | 18 | 25 | 10 | | 0.210 |
| 7 | D | 5 | 2 | 18 | 25 | 10 | | 0.232 |
| 8 | D | 2 | 5 | 18 | 25 | 10 | | 0.208 |
| 9 | E | 18 | 2 | 5 | 25 | 8 | 13.5 | 0.198 |
| 10 | F | 2 | 0 | 24 | 26 | 5 | 22.0 | 0.220 |

The table shows that when using paper D (80 CU, test 7) instead of paper C (60 CU, test 6) the diffusivity increases from 0.210 cm/s to 0.232 cm/s with the same printing solution. If the proportion of mid-molecular starch A is increased compared to the low-molecular starch MD (test 8), nearly the same diffusivity as in test 6 can be achieved.

As tests 9 and 10 show, satisfactory diffusivity values can also be achieved with a particularly low (10 CU) or a particularly high (200 CU) initial permeability of the cigarette paper.

Example 4: Influence of the Filler of the Cigarette Paper

The film-forming materials, the components of the printing solution and the geometry of the bands were as in EXAMPLE 1.

However, cigarette papers having the following characteristics were used:

Paper G

| | |
|---|---|
| Basis weight | 26 g/m2 |
| Fibers | flax pulp |
| Filler | calcium carbonate, 23% |
| Air permeability | 100 CU (=cm3/(cm2 min kPa)) |
| Burn additives | 2.0% tripotassium citrate (in % of the entire paper mass) |

Paper H

| | |
|---|---|
| Basis weight | 26 g/m2 |
| Fibers | flax pulp |
| Filler | calcium carbonate, 32% |
| Air permeability | 100 CU(=cm3/(cm2 min kPa)) |
| Burn additives | 2.0% tripotassium citrate (in % of the entire paper mass) |

TABLE 4

| | | Printing solution | | | | | Diffusivity |
|---|---|---|---|---|---|---|---|
| Test | Paper | Starch MD [%] | Starch A [%] | Starch B [%] | Sum Starch [%] | Chalk [%] | D* [cm/s] |
| 11 | G | 7 | 2 | 16 | 25 | 10 | 0.250 |
| 12 | H | 5 | 2 | 18 | 25 | 10 | 0.250 |

When changing from paper G with a filler content of 23% (test 11) to paper H with a filler content of 32% (test 12) it was necessary to shift the proportion of low-molecular starch MD considerably in favor of the high-molecular starch B to maintain the diffusivity of 0.250 cm/s. This is based on the fact that paper H with the higher filler content also has a higher initial diffusivity in the unprinted areas.

Example 5: Influence of the Burn Additives in the Cigarette Paper

The film-forming materials, the components of the printing solution, the geometry of the bands and the characteristics of the manufactured cigarettes were as in EXAMPLE 1. Paper A (test 13) and paper C (tests 14 and 15) were used, which differ only in their content of burn additives (1.0% and 1.4% citrate respectively).

TABLE 5

| | Printing solution | | | | | | | Diffusivity | | |
|---|---|---|---|---|---|---|---|---|---|---|
| Test | Starch MD [%] | Starch A [%] | Starch B [%] | Sum Starch [%] | Chalk [%] | Viscosity [s] | Applied amount [g/m$^2$] | D* [cm/s] | SE [%] | FB [%] |
| 13 | 0 | 5 | 17 | 22 | 5 | 18.5 | 4.30 | 0.354 | 87.5 | 100 |
| 14 | 0 | 5 | 17 | 22 | 5 | 18.5 | 4.10 | 0.435 | 62.5 | 100 |
| 15 | 0 | 2 | 20 | 22 | 5 | 19.0 | 4.05 | 0.365 | 77.5 | 100 |

The table shows that when changing from paper A to paper C with the same printing solution, the diffusivity increases from 0.354 cm/s (test 13) to 0.435 cm/s (test 14). At the same time, the SE value decreases from 87.5% to 62.5% and is therefore below the acceptable value of 75%. The reason for this is that the burn additives accelerate the thermal degradation of the paper and therefore increase diffusivity after heating the paper.

By increasing the content of high-molecular starch B from 17% to 20% and reducing the proportion of mid-molecular starch A from 5% to 2%, a diffusivity of 0.365 cm/s can ultimately be achieved in test 15, which leads to an acceptable SE value of 77.5%.

A higher content of burn additives thus has to be compensated for by decreasing diffusivity, which is possible by increasing the content of high-molecular starch.

In this example also, only the proportions of the starches in the printing solution were changed, while the viscosity, solids content and the applied amount remained virtually unchanged.

Example 6: Production of a Film-Forming Composition

To produce the film-forming composition, a double wall or jacketed tank, for example from the company ENCO Energie Componenten GmbH, can be used, which can be heated with steam. The tank should be equipped with a stirrer, for example consisting of a dispersing disc and two propeller stirrers.

Initially, a defined amount of water is filled into the tank and a corresponding amount of calcium carbonate, for example 5 or 11% by weight, is added to the composition with stirring. The calcium carbonate is dispersed for approximately 5 minutes. The suspension is then heated to 50° C. and the corresponding amount of a starch mixture is added. The temperature of the finished composition is then maintained at 90° C. for approximately 20 minutes; the composition is then ready for use.

As an alternative to calcium carbonate, aluminum hydroxide can also be used and serves the same purpose, namely an improvement of the optical characteristics of the bands, in particular an increase in opacity.

Example 7: Adjustment of a Film-Forming Composition

Depending on the paper characteristics, recommended starting values for the production of a printing solution to obtain a diffusivity of approximately 0.3 cm/s are those given in Table 6. These values must then be adjusted to the filler content and the content of burn additives of the paper as well as the content of calcium carbonate in the printing solution. The values in the table apply to a filler content of 25% and 1% tripotassium citrate in the paper and 5% calcium carbonate in the printing solution.

TABLE 6

| Pulp | Air permeability [CU] | Starch MD [%] | Starch A [%] | Starch B [%] |
|---|---|---|---|---|
| Wood | 40 | 5 | 0 | 17 |
| | 60 | 2 | 3 | 17 |
| | 80 | 0 | 5 | 17 |
| Flax | 60 | 7 | 2 | 16 |
| | 80 | 4 | 4 | 17 |
| | 100 | 0 | 7 | 18 |

Example 8: Thermogravimetric Curves

FIG. 1 shows a thermogravimetric curve (TGA curve) of the two starches A and B. The samples are heated in a nitrogen atmosphere at a heat rate of 5° C./min up to 500° C., and the weight loss (in %) is measured by simultaneous weighing of the sample.

It can be seen in FIG. 1, that the high-molecular starch B degrades somewhat more slowly, that is to say at higher temperature, than the low-molecular starch A. Therefore starch B is capable of resisting the thermal decomposition on the cigarette paper for longer, whereby the film formed on the cigarette paper stays intact for longer. Therefore the diffusivity of the printed areas of the paper is lower when using starch B compared to use of starch A. Thus, the proportion of starch B should be selected to be higher if it is desired to reduce diffusivity.

What is claimed is:

1. A method for manufacturing a cigarette paper comprising the following steps:

(a) providing a base cigarette paper having a diffusivity of 0.1 to 3 cm/s, measured at room temperature, and/or an air permeability of 10 to 200 CORESTA units;

(b) providing a film-forming composition, said film-forming composition comprising a solvent and at least two film forming agents, selected from the group consisting of the film-forming agents A, B and C, of which the molecular weight distributions are statistically significantly different, wherein the content of each film-forming agent in the composition is selected such that the total content of film-forming agents in the composition is 15 to 30% by weight and the viscosity of the composition is from 13 to 22 s measured using a DIN 4 cup at 70° C., and wherein the film-forming agent A has a mean molecular weight of 200,000±50,000 g/Mol, the film-forming agent B has a mean molecular weight of 600,000±150,000 g/Mol, and the film-forming agent C has a mean molecular weight of 100,000±25,000 g/Mol and wherein the content of said two or three film forming agents A, B and C when selected is as follows: film-forming agent A when selected is 5 to 15% by weight, the content of film-forming agent B when selected is 15 to 22% by weight, and the content of film-forming agent C when selected is 2 to 15% by weight of the film-forming composition and wherein the film-forming agents A, B and/or C are selected independently from one another from the group consisting of starch, starch derivatives and starch degradation products;

(c) applying the film-forming composition to the cigarette paper by means of intaglio printing or flexographic printing.

2. The method according to claim 1, wherein the content of each film-forming agent in the composition is selected such that the diffusivity in one or more discrete areas of the cigarette paper, in which the composition is applied, is between 0.08 and 0.5 cm/s, measured after the paper has been heated to 230° C. for 30 minutes.

3. The method according to claim 1, wherein the content of each film-forming agent in the composition is selected such that the diffusivity in one or more discrete areas of the cigarette paper, in which the composition is applied, is between 0.2 and 0.4 cm/s, measured after the paper has been heated to 230° C. for 30 minutes.

4. The method according to claim 1, wherein the content of each film-forming agent in the composition is selected such that the diffusivity in one or more discrete areas of the cigarette paper, in which the composition is applied, is between 0.25 and 0.35 cm/s, measured after the paper has been heated to 230° C. for 30 minutes.

5. The method according to claim 1, wherein the film-forming composition comprises two film-forming agents A and B or A and C or B and C.

6. The method according to claim 1, wherein the film-forming composition comprises three film-forming agents A and B and C.

7. The method according to claim 1, wherein the film-forming agent A and/or B is/are a potato starch or a derivate thereof, and the solvent is an aqueous solvent or water.

8. The method according to claim 1, wherein the film-forming agent C is a degraded starch or a derivative thereof, and the solvent is an aqueous solvent or water.

9. The method according to claim 1, wherein the film-forming agent C is a maltodextrin or a derivate thereof, and the solvent is an aqueous solvent or water.

10. The method of claim 1, wherein the film-forming composition further comprises at least one or more additives, selected from the group consisting of carbonates and oxides.

11. The method according to claim 10, wherein the content of additives is up to 15% by weight.

12. The method according to claim 1, wherein in the film-forming composition the total solids content, including the film-forming materials and optionally at least one additive is 15 to 45% by weight.

13. The method of claim 1, wherein the film-forming composition is applied in an amount of 2.5 to 6 g/m$^2$.

14. The method according to claim 1, wherein the base cigarette paper further comprises one or more burn additives, said one or more burn additives being citrates.

15. The method of claim 14, wherein said citrates are one of a sodium citrate and a tripotassium citrate.

* * * * *